US007841969B1

(12) United States Patent
Moran et al.

(10) Patent No.: US 7,841,969 B1
(45) Date of Patent: Nov. 30, 2010

(54) UPPER BODY EXERCISE APPARATUS AND METHOD OF USE

(75) Inventors: Thomas H Moran, Madison, WI (US); Noel R Johnson, Stoughton, WI (US)

(73) Assignee: Johnson Health Tech Co., Ltd. (TW)

( * ) Notice: Subject to any disclaimer, the term of this patent is extended or adjusted under 35 U.S.C. 154(b) by 0 days.

(21) Appl. No.: 12/604,081

(22) Filed: Oct. 22, 2009

(51) Int. Cl.
*A63B 22/00* (2006.01)
*A63B 22/12* (2006.01)

(52) U.S. Cl. ..... 482/62; 482/51

(58) Field of Classification Search ..... 482/51–52, 482/57–63, 110
See application file for complete search history.

(56) References Cited

U.S. PATENT DOCUMENTS 3,824,993 A * 7/1974 Grant ..... 601/36
5,044,627 A * 9/1991 Huang ..... 482/62
5,145,479 A * 9/1992 Olschansky et al. ..... 482/62
5,299,992 A * 4/1994 Wilkinson ..... 482/52
5,354,083 A * 10/1994 Liu ..... 280/233
6,447,428 B1 * 9/2002 McKillip ..... 482/57
6,547,702 B1 * 4/2003 Heidecke ..... 482/62
7,530,932 B2 * 5/2009 Lofgren et al. ..... 482/62
2005/0143226 A1 * 6/2005 Heidecke ..... 482/62
2006/0116248 A1 * 6/2006 Lofgren et al. ..... 482/62
2006/0264301 A1 * 11/2006 Kuo ..... 482/52
2008/0220947 A1 * 9/2008 Meng ..... 482/62

* cited by examiner

*Primary Examiner*—Steve R Crow
(74) *Attorney, Agent, or Firm*—Robert Burck

(57) ABSTRACT

An exercise apparatus including a frame, a flywheel, a drive unit for imparting rotation to the flywheel, a pair of crank arms, and a pair of hand pedals for rotating the crank arms. The drive unit is rotatably mounted to the frame to allow the operator to rotate the drive unit 180 degrees relative to the frame so that the hand pedals and crank arms are reversed when the drive unit is rotated.

20 Claims, 14 Drawing Sheets

UPPER BODY EXERCISE APPARATUS AND METHOD OF USE

FIELD OF THE INVENTION

The present invention relates generally to the field of exercise equipment, and more specifically to exercise apparatus for aerobic, strength, and cardiovascular conditioning that permits an operator to perform an upper body spinning bike exercise.

BACKGROUND OF THE INVENTION

There are numerous exercise devices, and in particular, a number of exercise cycles. Most exercise cycles are designed to condition the legs. A popular exercise to condition the legs is spinning, using a spinning bike. A spinning bike is a stationary exercise bike that includes a frame, a seat, handlebars, brake mechanism, pedals, and a flywheel connected to the pedals, typically without a clutch mechanism between the pedals and the flywheel. It is a very good exercise device for conditioning the legs, in part, because the pedals rotate when the flywheel is rotating, and vice-versa. Force is required to be applied to the pedals to accelerate the rate of rotation of the spinning flywheel, and force is required to be applied to the pedals to decelerate the rate of rotation of the spinning flywheel, thereby requiring effort on the part of the operator to accelerate and decelerate the flywheel.

There are fewer options for upper body exercise cycles. An example of one type of device designed to exercise the arms is an upper body ergometer (UBE) that uses hand pedals attached to crank arms to drive the rotation of a flywheel.

A first type of upper body ergometer is designed to accelerate a flywheel when force is applied to the hand pedals to rotate the crank arms in a first direction, and to decelerate the flywheel when force is applied to the hand pedals in a second reverse direction. The hand pedals rotate when the flywheel is spinning, and the flywheel spins when the hand pedals are rotating. The first type of upper body ergometer is similar in function to spinning bikes used for conditioning the legs.

A second type of upper body ergometer is designed with a clutch mechanism so that rotation of the hand pedals to rotate the crank arms in a first direction will accelerate the flywheel, while rotation of the hand pedals in the opposite direction will cause the crank arms to freewheel. The second type of upper body ergometer is similar to many road bikes which impart rotation to the rear wheel when the crank arms are rotated in a first direction, but which allow the crank arms to spin freely when crank arms are rotated in the reverse direction.

The first type of upper body ergometer, where the hand pedals are forced to spin any time the flywheel is spinning, provides a very good upper body exercise, because the operator expends energy and effort to both increase and decrease the rate of rotation of the flywheel. One disadvantage of the first type of upper body ergometer is that the spinning flywheel continues to spin the hand pedals, and there is inertia stored in the flywheel. The more inertia that is stored in the flywheel, the harder it is for an operator to decelerate the rotation of the hand pedals. If an operator desires to stop spinning the hand pedals, or if the operator's arms get tired, the operator must either apply a lot of effort to force the flywheel and hand pedals to stop spinning, or the operator must let go of the hand pedals and wait for friction to slow the flywheel and hand pedals to a stop.

A foot-operated brake mechanism can be used to slow or stop the rotation of the hand pedals and flywheel, but a foot-operated brake mechanism may not be a desirable solution, as upper body ergometers are often used by operators who are disabled or otherwise unable to use their legs. A hand-operated brake mechanism can be used to slow or stop the rotation of the hand pedals and flywheel, but a hand-operated brake mechanism may not be a desirable solution either, as the operator already has both hands engaged in operation of the hand pedals. The first type of upper body ergometer therefore has disadvantages.

The second type of upper body ergometer is designed to accelerate a flywheel when the hand pedals are operated to rotate the crank arms in a first direction, but to allow the crank arms to freewheel when the hand pedals are operated to rotate the crank arms in a second reverse direction. The second type of upper body ergometer provides the benefit of exercising the upper body, while allowing the operator to stop rotating the hand pedals at any time. One disadvantage of the second type of upper body ergometer is a lack of variety in the exercise, as the design limits the exercise to rotating the hand pedals under load around a single closed loop path moving in a single direction. Another disadvantage of the second type of upper body ergometer is that the muscles utilized during the course of the exercise only fire in one specific sequence as the operator rotates the pedals under load around a single closed loop path moving in a single direction. A third disadvantage of the second type of upper body ergometer is that the muscles utilized during the course of the exercise are exercised less effectively due to the fact that the muscles are restricted to pushing at specific locations along the path of travel of the hand pedals, and pulling at other specific location along the path of travel of the hand pedals.

A need remains for an exercise apparatus to exercise an operator's upper body, without the disadvantages described above.

SUMMARY OF THE INVENTION

The present invention provides an exercise apparatus and methods to allow an operator to exercise the upper body by exerting effort to rotate a pair of hand pedals about a closed loop path in a first direction or in a second reverse direction while allowing the operator to stop rotation of the hand pedals at any time.

In an exemplary embodiment of the present invention, a frame supports a flywheel, a drive unit rotatably mounted to the frame, a pair of crank arms rotatably mounted to the drive unit, and a pair of hand pedals respectively mounted to the pair of crank arms, where each hand pedal is configured to engage an operator's hand. The drive unit is configured to be rotated on the frame to allow the drive unit, the cranks arms, and the hand pedals to be rotated 180 degrees relative to the frame, so that the drive unit has a first position and a second position rotated 180 degrees from the first position. When the drive unit is in the first position, the drive unit is configured to impart rotation to the flywheel when the crank arms are rotated in a first direction, and to allow the crank arms to freewheel when the crank arms are rotated in a second reverse direction. When the drive unit is in the second position, rotated 180 degrees from the first position, the drive unit is reversed on the frame, and the operation of the exercise apparatus is substantially reversed. In other words, when the drive unit is in the second position, the drive unit is configured to impart rotation to the flywheel when the crank arms are rotated in the second direction, and to allow the crank arms to freewheel when the crank arms are rotated in the first direction.

The present invention may also include a seat to support the operator, a resistance device to impede rotation of the flywheel, and a locking mechanism to lock the drive unit into at least the first position and the second position. The seat of the exercise apparatus may be removable to allow access by an operator using a wheelchair, or the seat may be removed to allow an operator to stand while using the exercise apparatus.

This summary is not meant to be exhaustive. Further features, aspects, and advantages of the present invention will become better understood with reference to the following description, accompanying drawings and appended claims.

DESCRIPTION OF THE PREFERRED EMBODIMENTS

Figure 1:
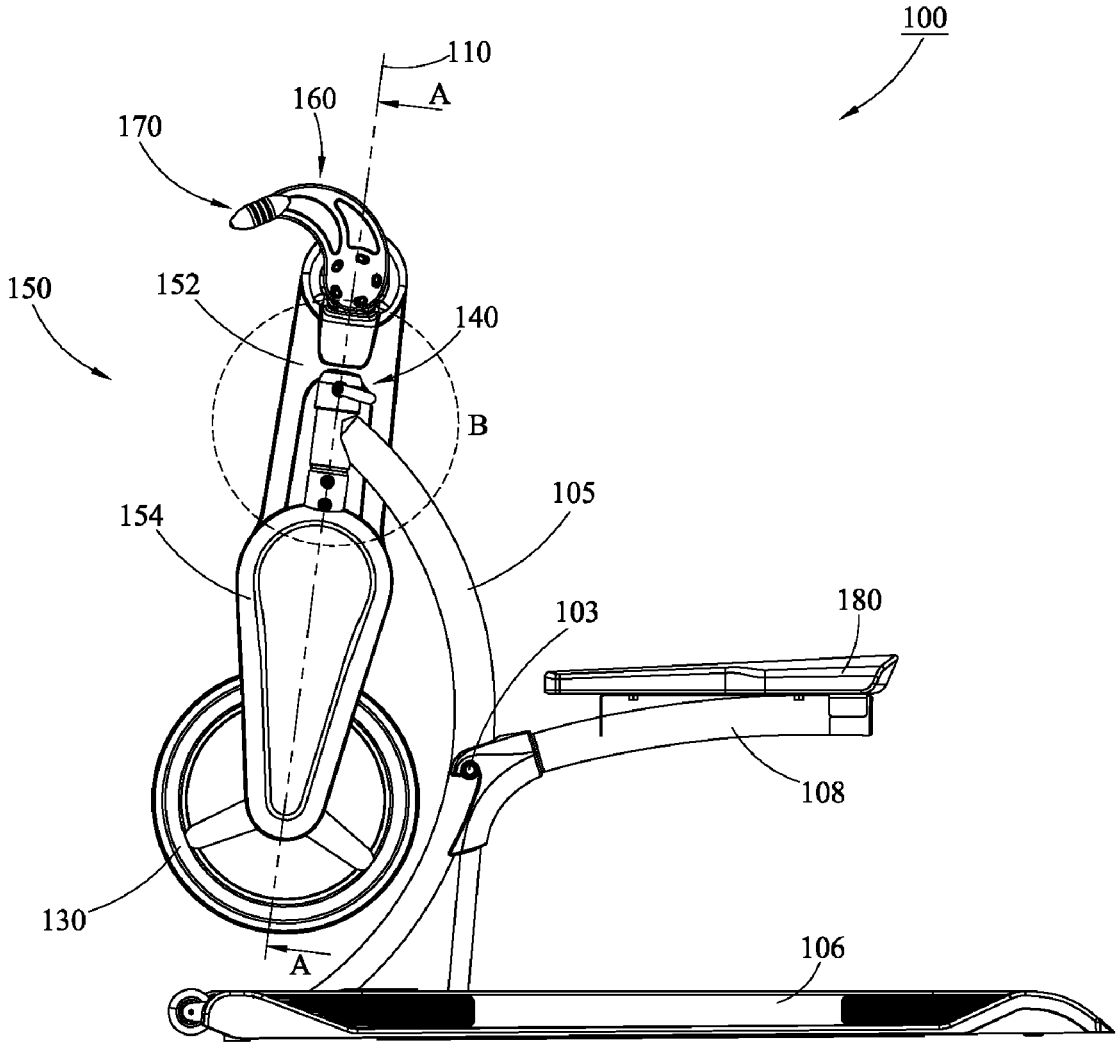
FIG. 1 is a side view of an exercise apparatus constructed according to the principles of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

An exercise apparatus constructed according to the principles of the present invention is designated as 100 in FIGS. 1-4. The exercise apparatus 100 generally includes a frame 105, a drive unit 150 rotatably mounted to the frame 105 about a first axis 110, a locking mechanism 140 to prevent rotation between the drive unit 150 and the frame 105, a pair of crank arms 160 rotatably mounted to the drive unit 150 about a second axis 120 (shown in FIG. 4), a pair of hand pedals 170 mounted to the respective crank arms 160, and a flywheel 130. Also shown in FIG. 1 is a base structure 106, a seat frame 108, and a seat 180.

The crank arms 160 include a first crank arm 161 and a second crank arm 162. The pair of hand pedals 170 include a first hand pedal 171 mounted to the first crank arm 161 and a second hand pedal 172 mounted to the second crank arm 162. The drive unit 150 has an upper portion 152 and a lower portion 154. Each crank arm 161, 162 is rotatably connected to the upper portion 152 of the drive unit 150, and both crank arms 161, 162 are configured to be rotated about the second axis 120. To use the exercise apparatus 100, an operator grasps the hand pedals 170 and starts to rotate at least one crank arm 160 about the second axis 120. The flywheel 130 is rotatably connected to the lower portion 154 of the drive unit 150, and the drive unit 150 is configured such that the rotation of either crank arm 161, 162 in a first direction imparts rotation to the flywheel 130, and rotation of either crank arm 161, 162 in a second direction causes the respective crank arm 161, 162 to freewheel, so that rotation of either crank arm 161, 162 in the second direction does not impart rotation to the flywheel 130. The operator may grasp the hand pedals 170 and rotate either crank arm 161, 162 or both crank arms 160 in the first direction to impart rotation to the flywheel 130, and the operator may stop rotation of either crank arm 161, 162 or both crank arms 160 at any time while the flywheel 130 continues to rotate.

To impart rotation to the flywheel 130, the operator must apply force to at least one hand pedal 171, 172 to rotate at least one crank arm 161, 162 in the first direction. The operator engages muscles in the upper body to apply force to impart rotation to the flywheel 130, thereby exercising the upper body. When the operator chooses to rest, the operator stops rotating one or both crank arms 160.

Referring to FIG. 1, the two crank arms 161, 162 are shown aligned with one another. However, the two crank arms 161, 162 are configured to allow each crank arm 161, 162 to rotate independently of the other crank arm 161, 162. Therefore, while the crank arms 161, 162 may be rotated in tandem so that the crank arms 161, 162 remain aligned with each other throughout the rotation of the crank arms 161, 162, the crank arms 161, 162 may also be repositioned with respect to one another.

Figure 2:
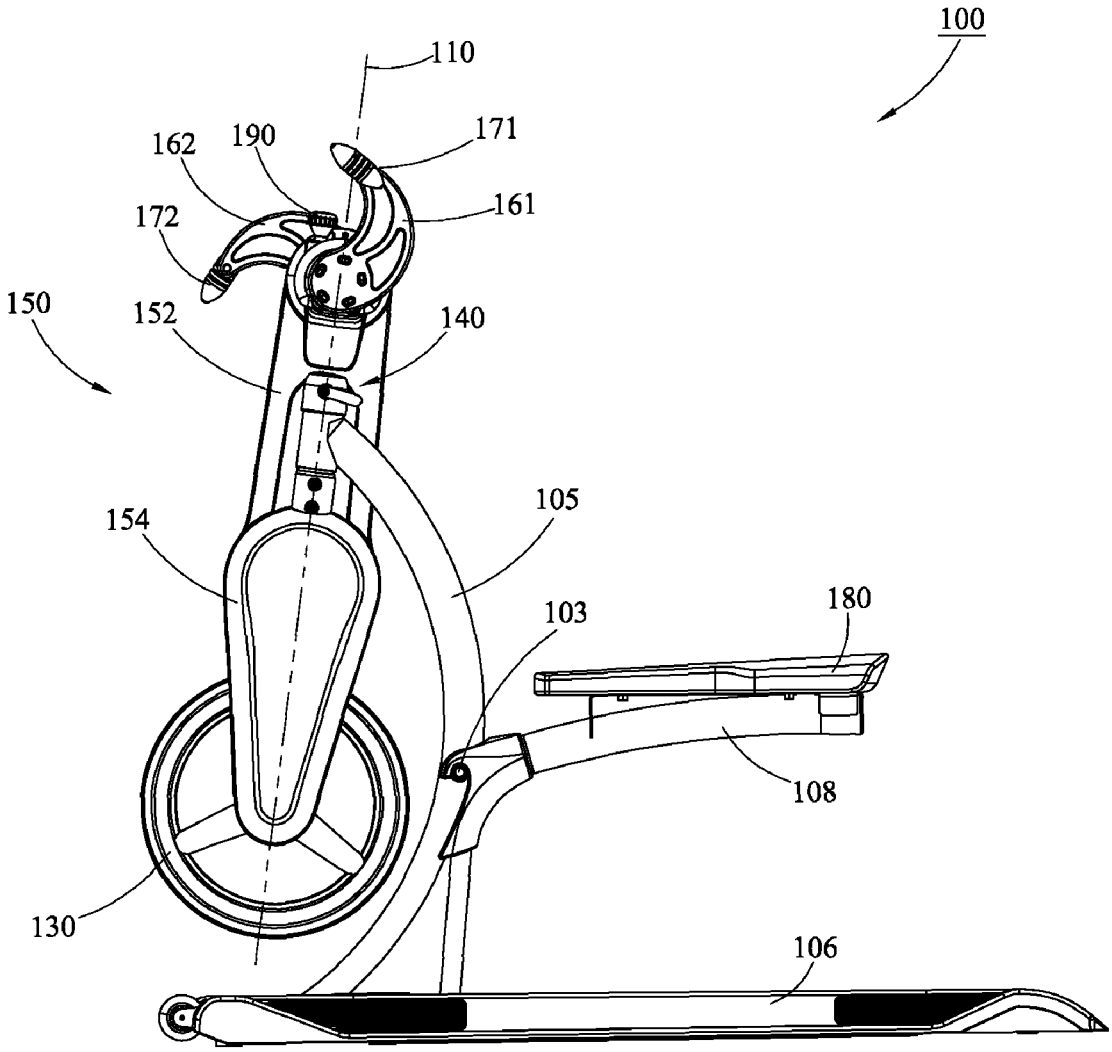
FIG. 2 is the side view of FIG. 1 showing the two crank arms rotated 90 degrees apart.

Referring to FIG. 2, the two crank arms 161, 162 are shown offset from one another by an angle of approximately 90 degrees. Because either crank arm 161, 162 may be rotated in either a first direction or a second direction, and because either of the two crank arms 161, 162 are able to be rotated independent of the other crank arm 161, 162, it is a simple procedure for an operator to rotate the first crank arm 161 in the first direction while holding the second crank arm 162 stationary, or to rotate the first crank arm 161 in the second direction while holding the second crank arm 162 stationary, or to rotate both crank arms 161, 162 simultaneously, but at different rates or in different directions to change the angle between the two crank arms 161, 162. Similarly, the operator may rotate the second crank arm 162 in the first direction while holding the first crank arm 161 stationary, or to rotate the second crank arm 162 in the second direction while holding the first crank arm 161 stationary. The operator is able to adjust the relative angle between the two crank arms 161, 162 on the fly while exercising without having to remove either hand from the two hand pedals 171, 172.

Figure 3:
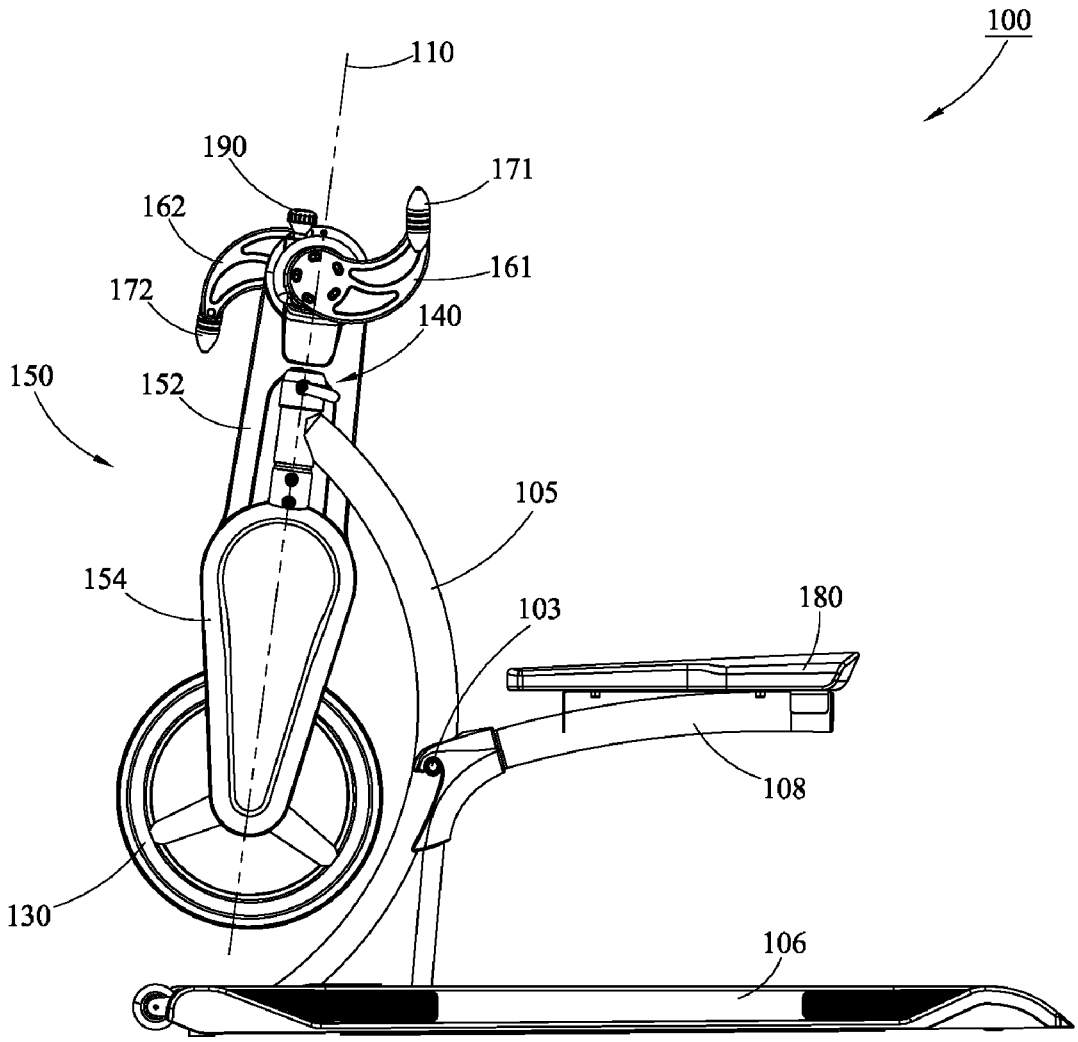
FIG. 3 is the side view of FIG. 1 showing the two crank arms rotated 180 degrees apart.

Referring to FIG. 3, the two crank arms 161, 162 are shown offset from one another by an angle of approximately 180 degrees. However, it should be noted that two crank arms 161, 162 are infinitely adjustable, and either crank arm 161, 162 may be positioned at any angle relative to the other crank arm 161, 162.

Figure 4:
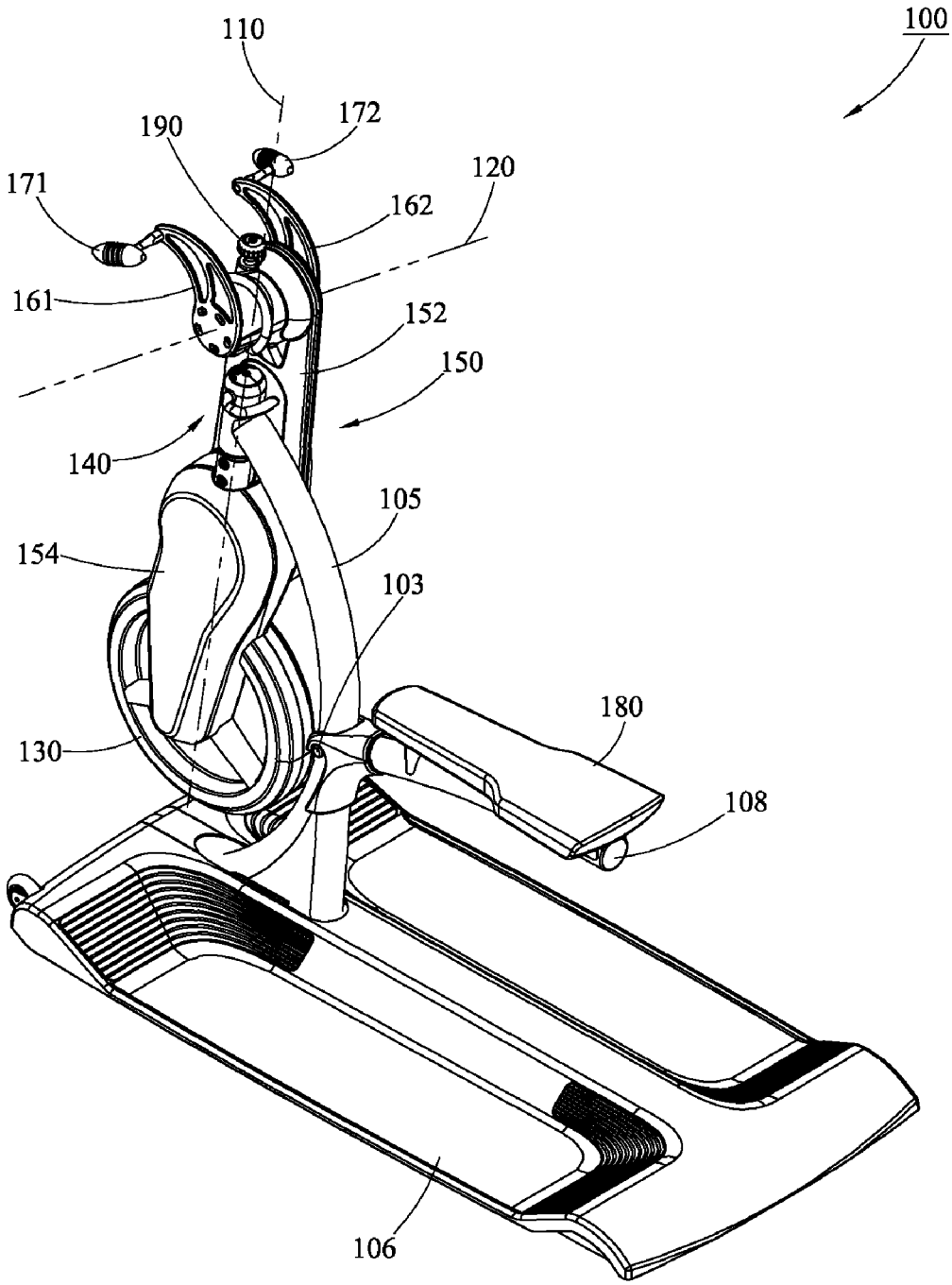
FIG. 4 is a perspective view of the exercise apparatus of FIG. 1.

Referring to FIG. 4, the second axis of rotation 120 is shown, where the second axis of rotation 120 is defined as the axis about which the two crank arms 161, 162 rotate relative to the drive unit 150. Connected to the upper portion 152 of the drive unit 150, between the two crank arms 161, 162, is a control device 190 configured to adjust the level of resistance of the exercise apparatus 100. The operator may rotate one or both crank arms 161, 162 to impart rotation to the flywheel 130. The operator may adjust the control device 190 to either increase the resistance level or decrease the resistance level, where increased resistance requires the operator to exert more effort to impart rotation to the flywheel 130, and where decreased resistance allows the operator to exert less effort to impart rotation to the flywheel 130.

Figure 5B:
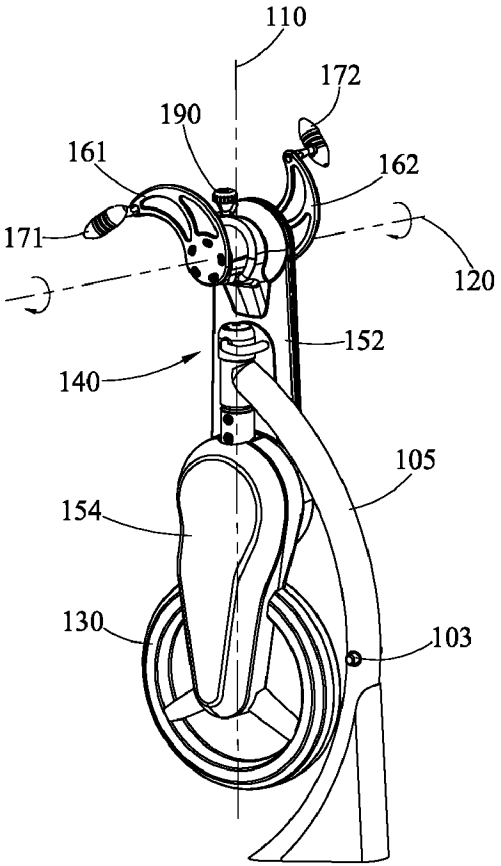
FIG. 5*b* is the perspective view of FIG. 5*a* showing rotation of the crank arms in a second direction.
Figure 5A:
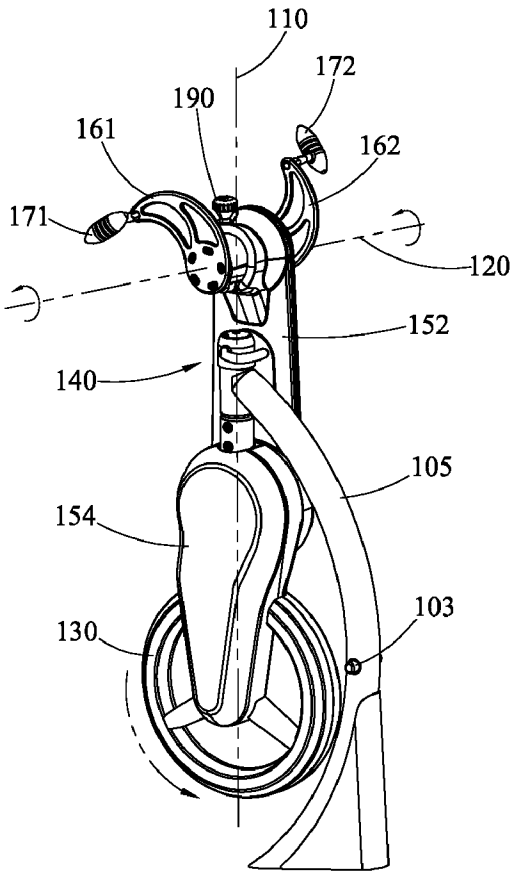
FIG. 5*a* is a perspective view of the drive unit of the exercise apparatus of FIG. 1, showing rotation of the crank arms in a first direction.

FIGS. 5*a*-7*b* show a close-up of the drive unit 150. Referring to FIG. 5*a*, the drive unit 150 is shown in a first position, and the locking mechanism 140 is shown in the locked position, thereby preventing rotation of the drive unit 150 relative to the frame 105. In other words, the locking mechanism 140 locks the drive unit 150 in the first position, and prevents rotation of the drive unit 150 about the first axis 110.

Referring to FIG. 5*a*, the operator is able to grasp the two hand pedals 171, 172 to rotate the two crank arms 161, 162 about the second axis 120. FIG. 5*a* shows the crank arms 161, 162 rotating in the first direction to impart rotation to the flywheel 130. As shown in FIG. 5*a*, rotation of either crank arm 161, 162 in the first direction rotates the respective crank arm 161, 162 in the counter-clockwise direction when seen from the left side of the frame 105. When the drive unit 150 is in the first position, as shown in FIGS. 5*a*-5*b*, rotation in the first direction (counter-clockwise rotation as seen from the left side) of either of the crank arms 161, 162 in turn imparts rotation to the flywheel 130, as shown by the arrow around the flywheel 130.

Referring to FIG. 5*b*, the crank arms 161, 162 are rotating in the second direction, which does not impart rotation to the flywheel 130. As shown in FIG. 5*b*, rotation of either crank arm 161, 162 in the second direction rotates the respective crank arm 161, 162 in the clockwise direction when seen from the left side of the frame 105. When the drive unit 150 is in the first position, as shown in FIGS. 5*a*-5*b*, rotation in the second direction (clockwise rotation as seen from the left side) of either of the crank arms 161, 162 causes the respective crank arm 161, 162 to freewheel, and does not impart rotation to the flywheel 130.

Figure 6:
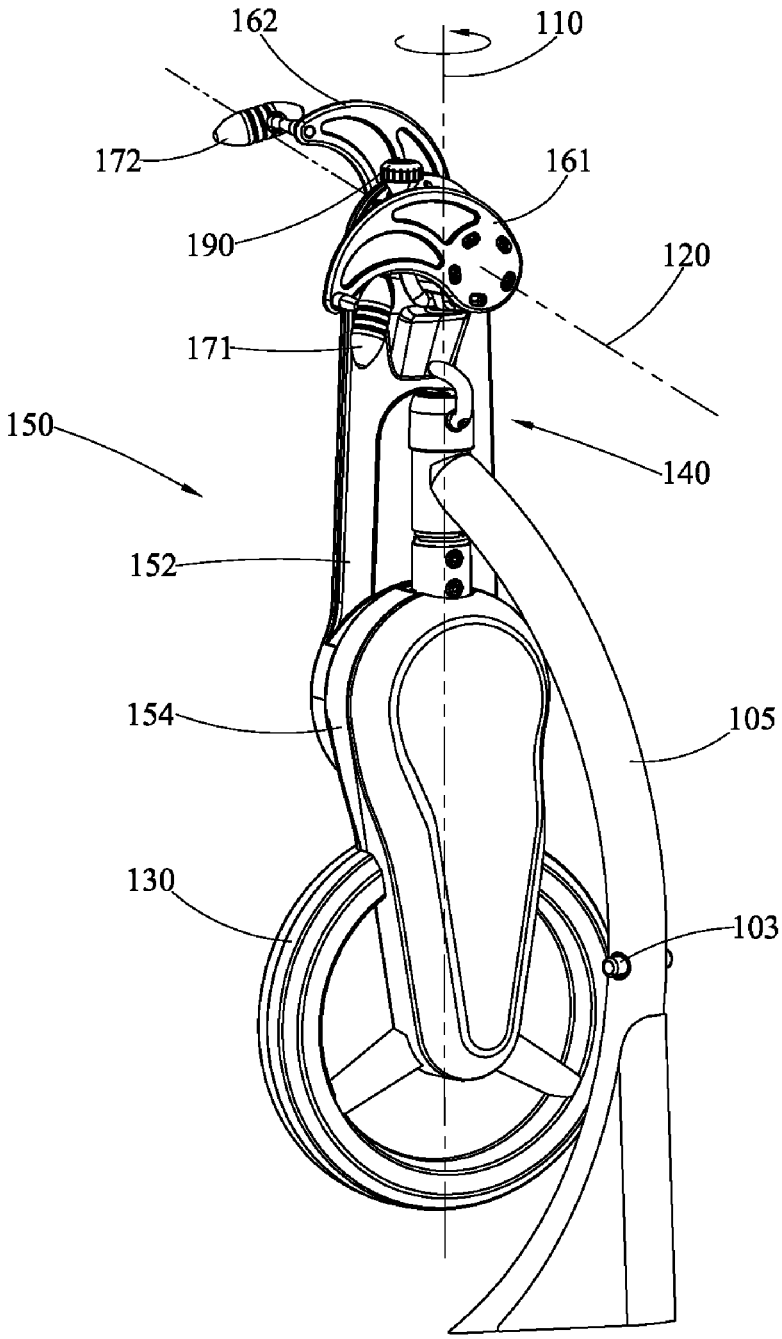
FIG. 6 is a perspective view of the drive unit of the exercise apparatus of FIG. 1, showing rotation of the drive unit.

Referring to FIG. 6, the locking mechanism 140 is shown in the unlocked position, thereby allowing rotation of the drive unit 150 relative to the frame 105. In other words, the locking mechanism 140 no longer prevents rotation of the drive unit 150 about the first axis 110, because the locking mechanism 140 does not lock the drive unit 150 into a fixed position relative to the frame 105. The drive unit 150 is shown partially rotated away from the first position toward a second position that is oriented 180 degrees away from the first position. As the drive unit 150 rotates about the first axis 110, the locking mechanism 140, the flywheel 130, the lower portion 154 of the drive unit 150, and the upper portion 152 of the drive unit 150 rotate about the first axis 110. In addition, the control device 190, the hand pedals 171, 172, the crank arms 161, 162, and the second axis 120 also rotate about the first axis 110 as the drive unit 150 rotates about the first axis 110.

Figure 7B:
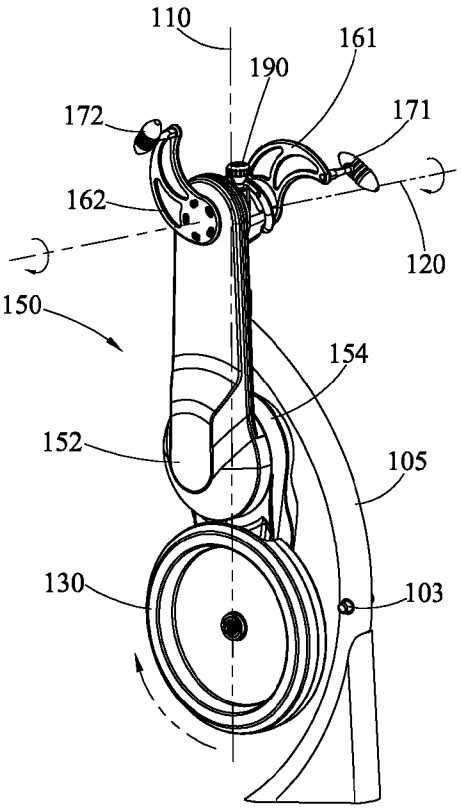
FIG. 7*b* is the perspective view of FIG. 7*a* showing rotation of the crank arms in a second direction.
Figure 7A:
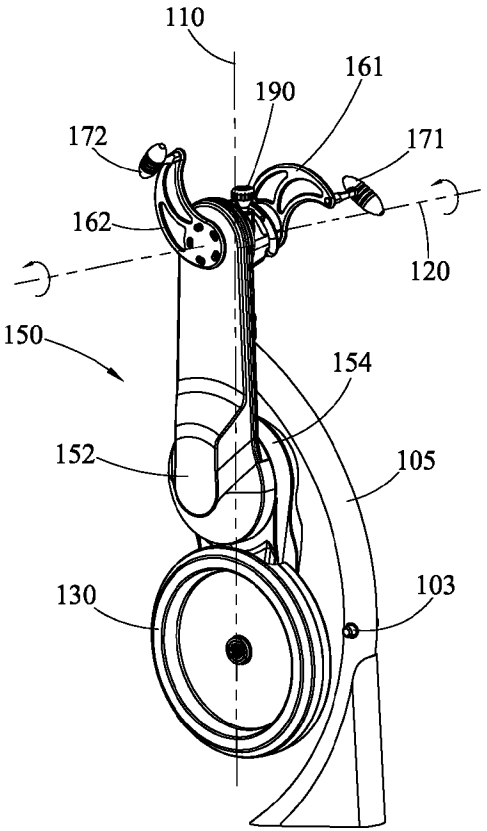
FIG. 7*a* is a perspective view of the drive unit of the exercise apparatus of FIG. 1, showing rotation of the crank arms in a first direction.

Referring to FIG. 7*a*, the drive unit 150 is shown in a second position, rotated 180 degrees from the first position that was shown in FIGS. 5*a*-5*b*. In FIGS. 7*a*-7*b*, the two crank arms 161, 162 have been reversed, so that the first crank arm 161 which had been on the left side of the frame 105 is now on the right side of the frame 105, and the second crank arm 162 which had been on the right side of the frame 105 is now on the left side. In FIGS. 7*a*-7*b*, the locking mechanism 140 is hidden behind the drive unit 150, but locking mechanism 140 is configured to be locked again when the drive unit 150 is rotated into the second position, thereby preventing rotation of the drive unit 150 relative to the frame 105. In other words, the locking mechanism 140 now locks the drive unit 150 in the second position, and prevents rotation of the drive unit 150 about the first axis 110.

Referring to FIG. 7*a*, the crank arms 161, 162 are shown rotating in the first direction, which due to reversal of the drive unit 150 and the crank arms 161, 162 does not impart rotation to the flywheel 130. As shown in FIG. 7*a*, rotation of either crank arm 161, 162 in the first direction rotates the respective crank arm 161, 162 in the counter-clockwise direction when seen from the left side of the frame 105. When the drive unit 150 is in the second position, as shown in FIGS. 7*a*-7*b*, rotation in the first direction (counter-clockwise rotation as seen from the left side) of either of the crank arms 161, 162 causes the respective crank arm 161, 162 to freewheel, and therefore the rotation of either of the crank arms 161, 162 in the first direction does not impart rotation to the flywheel 130.

Referring to FIG. 7*b*, the crank arms 161, 162 are shown rotating in the second direction, which does impart rotation to the flywheel 130. As shown in FIG. 7*b*, rotation of either crank arm 161, 162 in the second direction rotates the respective crank arm 161, 162 in the clockwise direction when seen from the left side of the frame 105. When the drive unit 150 is in the second position, as shown in FIGS. 7*a*-7*b*, rotation in the second direction (clockwise rotation as seen from the left side) of either of the crank arms 161, 162 imparts rotation to the flywheel 130, as shown by the arrow around the flywheel 130.

Figure 8:
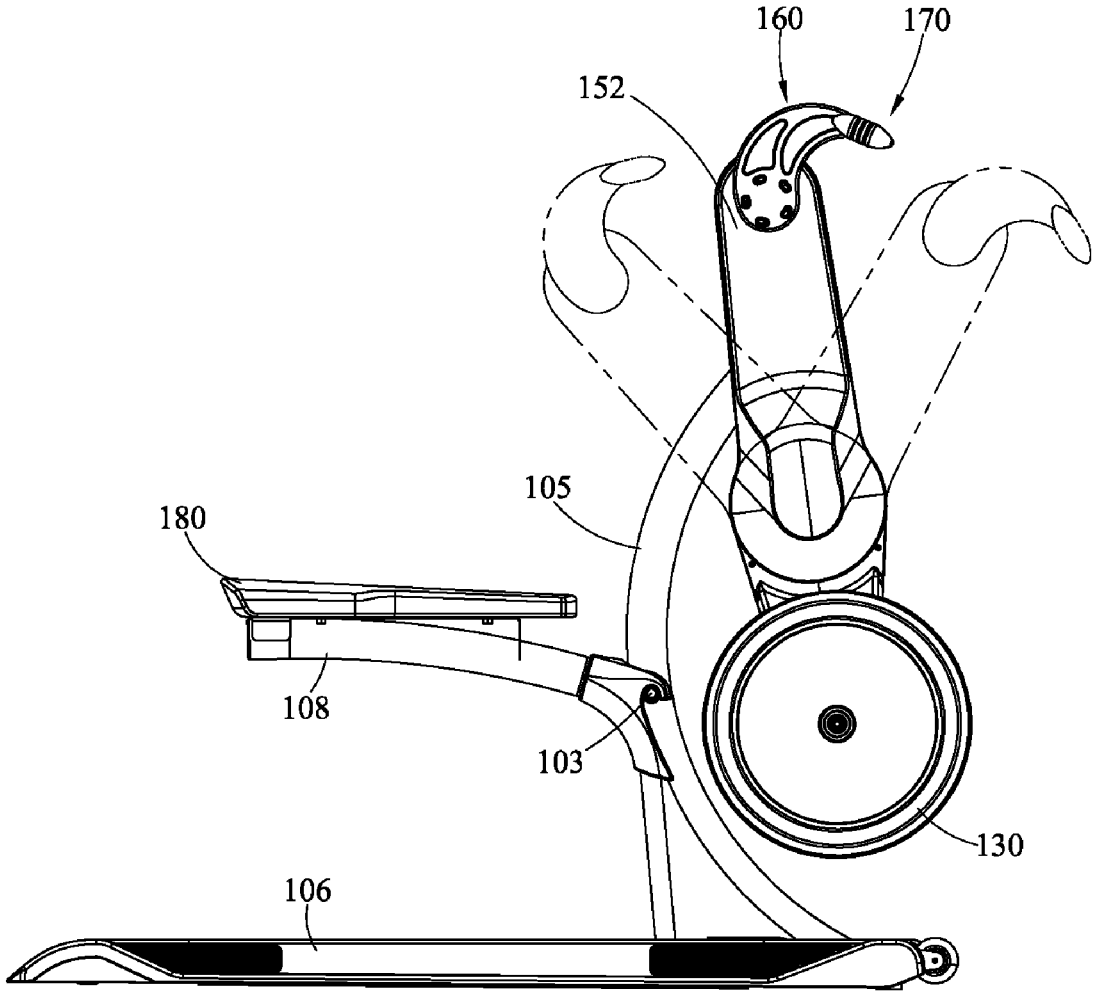
FIG. 8 is the side view of FIG. 1 showing a drive unit pivot.

Referring to FIG. 8, the frame 105 is shown to have a seat 180 positioned toward the rear end of the frame 105, and the drive unit 150 is positioned toward the front end of the frame 105. The drive unit 150 is shown to have an upper portion 152 and a lower portion 154. As shown in FIG. 8, the upper portion 152 of the drive unit 150 is pivotally connected to the lower portion 154 of the drive unit 150. The flywheel 130 is pivotally connected to the lower portion 154 of the drive unit 150, and the flywheel axis (not shown) intersects the first axis 110 and is substantially perpendicular to the first axis 110. The location of the flywheel 130 is substantially the same, though reversed, after rotation of the drive unit 150 about the first axis 110 by 180 degrees. The pivot between the lower portion 154 and the upper portion 152 of the drive unit 150 is configured to allow the upper portion 152 to be pivoted around a pivot axis (not show) that is substantially parallel to the second axis 120. Pivotally moving the upper portion 152 of the drive unit 150 toward the seat 180 moves the crank arms 161, 162 rearward. Pivotally moving the upper portion 152 of the drive unit 150 away from the seat 180 moves the crank arms 161, 162 forward. The operator can adjust the position of the crank arms 161, 162 by repositioning the upper portion 152 of the drive unit 150 to find a comfortable height and position for the crank arms 161, 162 and the hand pedals 171, 172.

Figure 9:
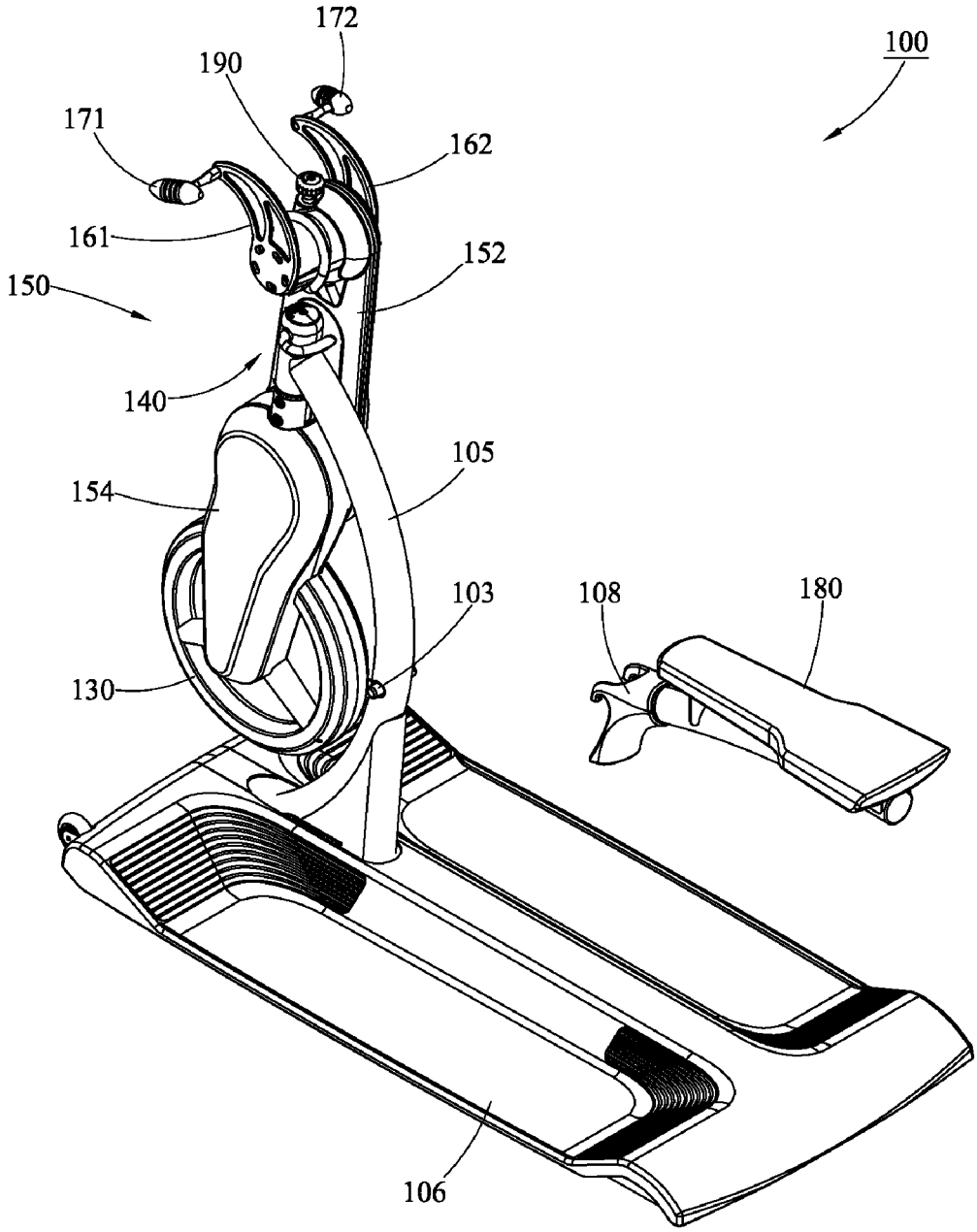
FIG. 9 is a perspective view of the exercise apparatus of FIG. 1 showing removal of the seat.

Referring to FIG. 9, the exercise apparatus 100 is shown with a removable seat 180. The seat 180 and seat frame 108 are shown removed from the exercise apparatus 100. The seat 180 and seat frame 108 are a single unit, and can easily be removed or installed onto the exercise apparatus 100. The frame 105 includes a dowel pin 103 inserted through the frame 105 with each end of the dowel pin 103 protruding from either side of the frame 105. The seat frame 108 includes a hook 107 configured to catch on the dowel pin 103 when the seat 180 is installed onto the exercise apparatus 100. The seat 180 may be easily removed from the exercise apparatus 100 by simply lifting the seat 180 and seat frame 108 upward. The hook 107 lifts easily from the dowel pin 103, allowing the seat 180 to be removed. This is particularly convenient, allowing those operators who want a sitting area on the exercise apparatus 100 to quickly install the seat 180, while allowing other operators, perhaps those using a wheelchair, to remove the seat 180 for easy access. When removed, the seat 180 and seat frame 108 can be set off to one side as a single unit, and quickly and easily reinstalled into the exercise apparatus 100 to reduce risk of damage or loss of the seat 180.

Additionally, a base structure 106 is shown attached to the frame 105. The base structure 106 is configured to support a typical wheelchair, and is shown having a contoured surface with ramps at both the front and back portions of the base structure 106. The ramps at the back portion of the base structure 106 chock the wheels of a wheelchair positioned on the base structure 106 so that an operator using a wheelchair is able to stably position a wheelchair on the base structure 106 before using the exercise apparatus 100. In other words, an operator who is using a wheelchair, and who is pushing and pulling on the hand pedals 171, 172 might typically have to worry that the hand pedals 171, 172 would exert an equal and opposite reaction on the operator in the wheelchair, causing the wheelchair to move around during operation of the exercise apparatus 100, but due to the configuration of the base structure 106, the wheelchair is stably positioned on the base structure 106.

Figure 11:
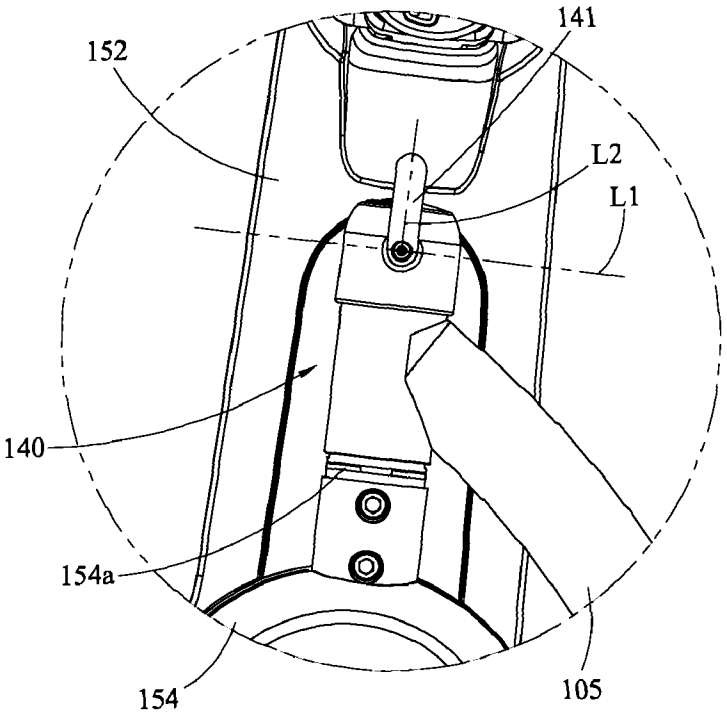
FIG. 11 is a detail view of the locking mechanism of the exercise apparatus of FIG. 1, with a lever shown in an unlocked position.
Figure 10:
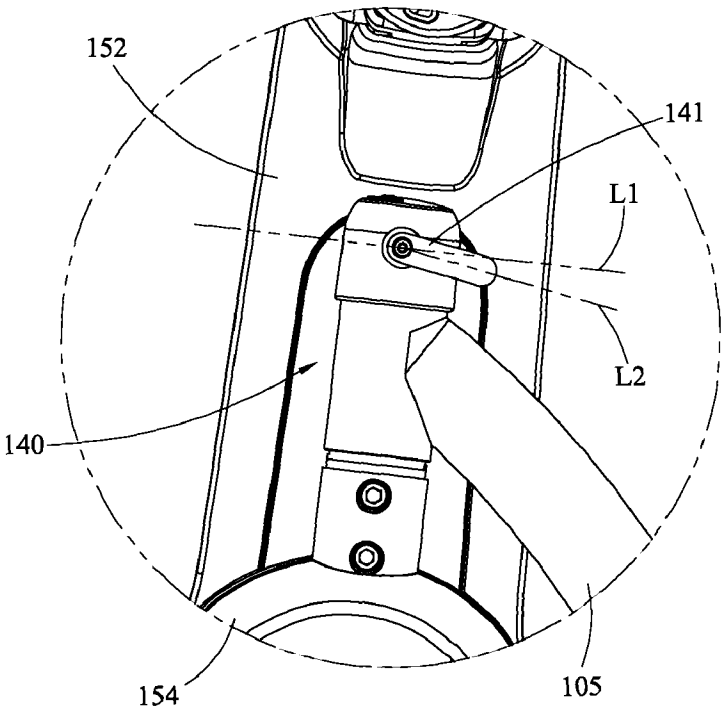
FIG. 10 is a detail view of the locking mechanism of the exercise apparatus of FIG. 1, with a lever shown in a locked position.

FIGS. 10-15 show the locking mechanism 140 in greater detail. Referring to FIGS. 10-11, the frame 105 supports the locking mechanism 140 and is configured to allow the locking mechanism 140 and the drive unit 150 to rotate about the first axis 110. The upper portion 152 of the drive unit 150 is shown behind and above the locking mechanism 140, while the lower portion 154 of the drive unit 150 is shown below the locking mechanism 140. Referring to FIG. 10, a lever 141 for engaging or disengaging the locking mechanism 140 is shown in a fully locked position. A first line segment L1 is shown representing a plane perpendicular to the first axis 110. A second line segment L2 is shown representing the orientation of the lever 141. The second line segment L2 is below the first line segment L1 when the lever 141 is in the fully locked position.

Referring to FIG. 11, the lever 141 for engaging or disengaging the locking mechanism 140 is shown in an unlocked position. The second line segment L2 is above the first line segment L1 and perpendicular to the first line segment L1 when the lever 141 is in the unlocked position. When the lever 141 is in the unlocked position, the drive unit 150 is lowered with respect to the frame 105, disengaging a tapered engagement feature 154*a* that is attached to the drive unit 150. When this tapered engagement feature 154*a* is disengaged from the frame 105, the drive unit 150 is enabled to rotate about the first axis 110.

Figure 12:
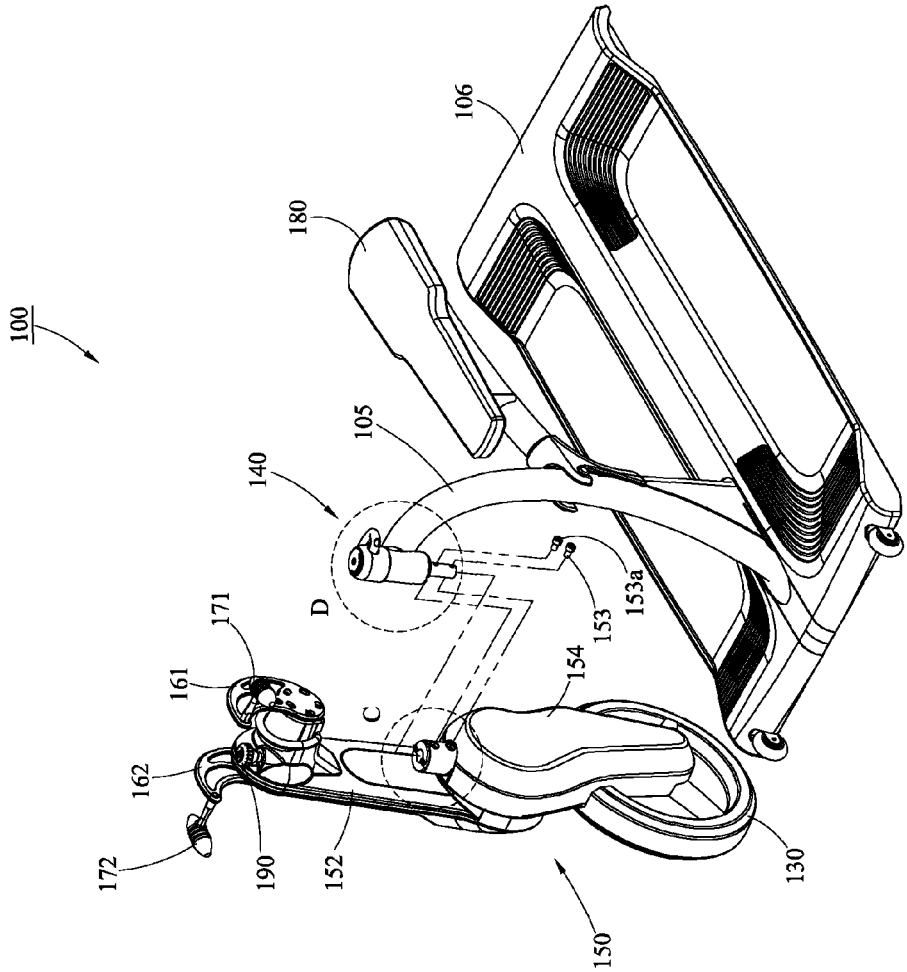
FIG. 12 is a partial exploded view of the exercise apparatus of FIG. 1.

FIGS. 12-15 show in greater detail how the locking mechanism 140 works to lock the drive unit 150 in place relative to the first axis 110. Referring to FIG. 12, the exercise apparatus 100 is shown with the drive unit 150 removed from the frame 105, the locking mechanism 140 rotatably attached to the frame 105, and two screws 153, 153*a* removed from the drive unit 150, thereby allowing the removal of the drive unit 150 from the locking mechanism 140.

Figure 13:
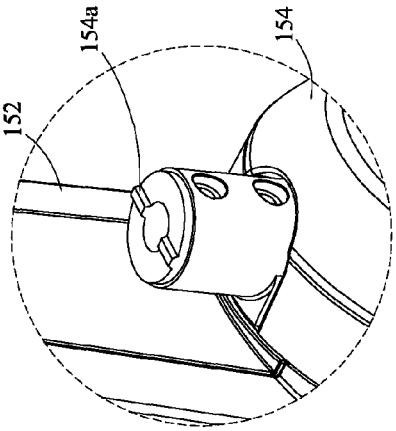
FIG. 13 is a detail view of a portion of the drive unit of the exercise apparatus of FIG. 12.

FIG. 13 is a detail view of a portion of the drive unit 150, showing both the upper portion 152 of the drive unit 150 and the lower portion 154 of the drive unit 150. Additionally, a tapered engagement feature 154*a* is shown. The tapered engagement feature 154*a* is configured to constrain rotation of the drive unit 150 about the first axis 110 when the locking mechanism 140 is engaged. In addition, the tapered engagement feature 154*a* is configured so that the drive unit 150 may be locked in either a first position relative to the frame 105, or a second position that rotated 180 degrees about the first axis 110 relative to the first position. The locking mechanism 140 engages or disengages the tapered engagement feature 154*a* with a mating feature 149*a* associated with the frame 105.

Figure 14:
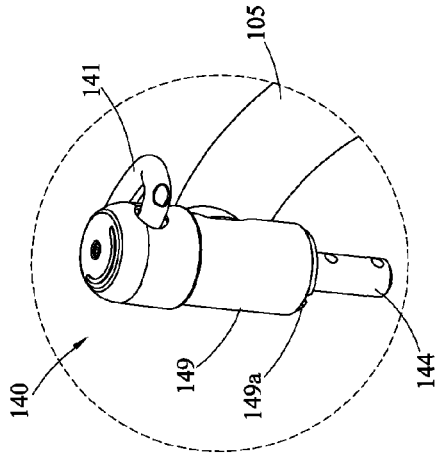
FIG. 14 is a detail view of the locking mechanism of the exercise apparatus of FIG. 12.

FIG. 14 is a detail view of a portion of the frame 105 and the locking mechanism 140, including a shaft 144, a housing 149, and a lever 141 for engaging or disengaging the locking mechanism 140. Additionally, a mating feature 149*a* is shown, where the mating feature 149*a* is a tapered notch in the housing 149 configured to mate with the tapered engagement feature 154*a* shown in FIG. 13. The housing 149 is attached to the frame 105, and the housing 149 and the mating feature 149*a* are configured to remain stationary relative to the frame 105, so that when the tapered engagement feature 154*a* is engaged with the mating feature 149*a*, the drive unit 150 is constrained so that the drive unit 150 is unable to be rotated about the first axis 110.

The locking mechanism 140 works by allowing the shaft 144 to move axially along the first axis 110 in addition to allowing the shaft 144 to rotate about the first axis 110. When the lever 141 is rotated up into the unlocked position (as shown in FIG. 11), the shaft 144 is configured to move downward, lowering the entire drive unit 150 and the tapered engagement feature 154*a*. When the tapered engagement feature 154*a* is lowered out of engagement with the mating feature 149*a*, the drive unit 150, the shaft 144, and the locking mechanism 140 are configured to be rotatable about the first axis 110. In other words, when the lever 141 is rotated up into the unlocked position, the drive unit 150 is rotatable relative to the frame 105 about the first axis 110.

When the lever 141 is rotated down into the locked position (as shown in FIG. 10 and FIG. 14), the shaft 144 is configured to move upward, raising the entire drive unit 150 and the tapered engagement feature 154*a*. The tapered engagement feature 154*a* is aligned with the mating feature 149*a* when the drive unit 150 is positioned in either the first position or the second position, and the tapered engagement feature 154*a* may be engaged with the mating feature 149*a*. When the tapered engagement feature 154*a* is raised into engagement with the mating feature 149*a*, the drive unit 150, the shaft 144, and the locking mechanism 140 are fixed in relation to the frame 105, so that the drive unit 150 is prevented from rotating about the first axis 110. In other words, when the lever 141 is rotated up into the locked position, the drive unit 150 is fixed in one of two positions relative to the frame 105.

Figure 15:
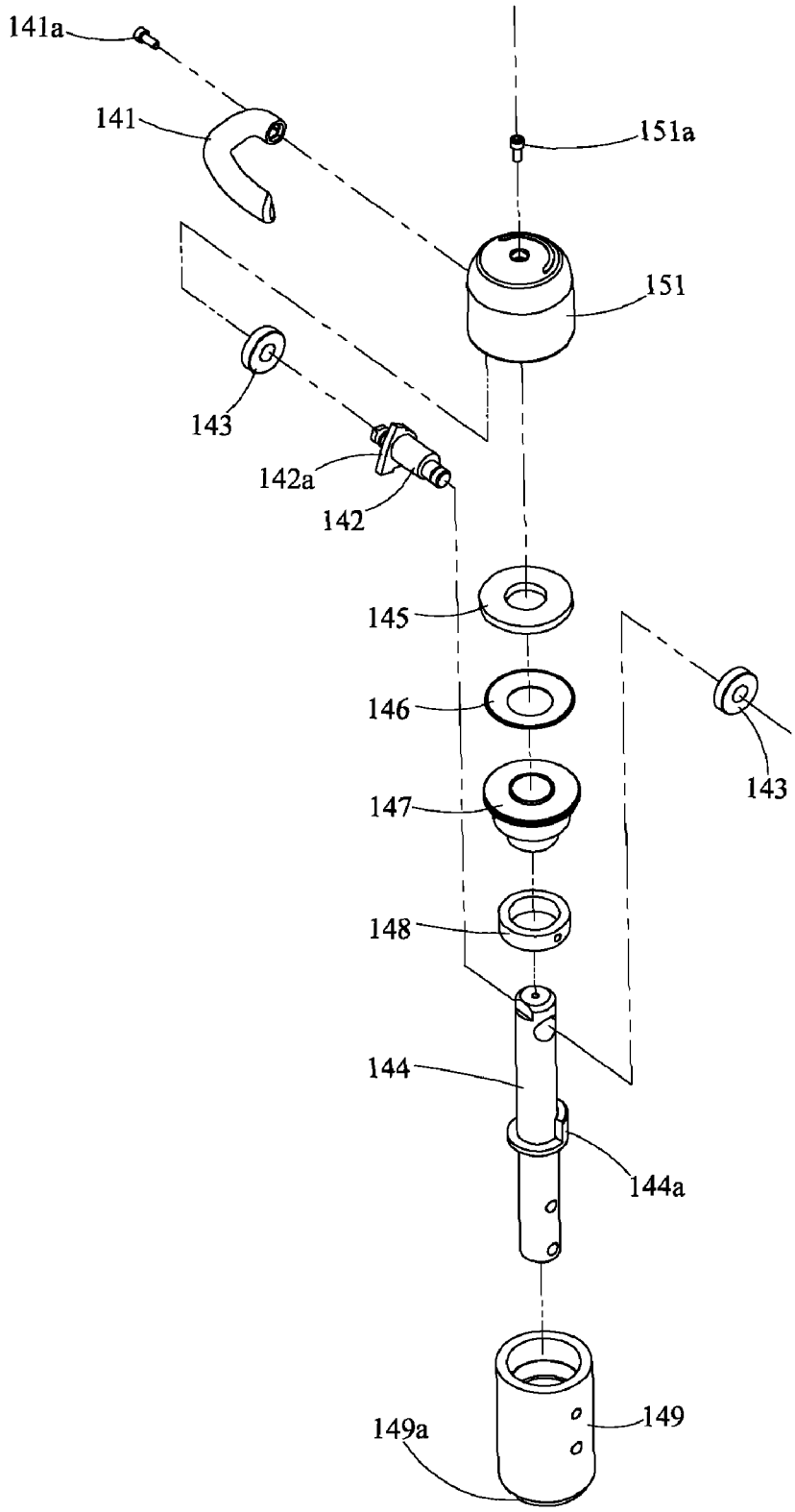
FIG. 15 is an exploded view of the locking mechanism of FIG. 14.

FIG. 15 is an exploded view of the locking mechanism 140. The locking mechanism 140 of the present invention includes a housing 149 with a mating feature 149*a*, a shaft 144 with a stop feature 144*a*, a lever 141, an eccentric cam 142 with a cam stop 142*a*, a pair of follower wheels 143, and a bearing surface 145. The locking mechanism 140 further includes a spring washer 146, a threaded support surface 147, a locking ring 148 and a cap 151.

The shaft 144 is constrained to rotate about the first axis 110 and move in the axial direction along the first axis 110 by the housing 149. The stop feature 144*a* interacts with the housing 149 to limit the range of rotation about the first axis 110. The bearing surface 145 is shaped like a washer and is positioned around the shaft 144. The bearing surface 145 is supported by the housing 149. The shaft 144 has a bore hole through the center of the shaft 144 and perpendicular to the axial direction. The eccentric cam 142 is inserted into the bore hole in the shaft 144, and a follower wheel 143 is attached to either end of the eccentric cam 142 such that the two follower wheels 143 are free to rotate about the eccentric cam 142 and the two follower wheels 143 are in rolling contact with the bearing surface 145 and are supported by the bearing surface 145. The lever 141 is attached to the eccentric cam 142 by a bolt 141*a* so that rotation of the lever 141 rotates the eccentric cam 142. A cap 151 covers the top of the locking mechanism 140 and is held in place by a screw 151*a*.

The operator may rotate the lever 141 to rotate the eccentric cam 142, thereby either raising or lowering the shaft 144. The shaft 144 is attached at its lower end to the drive unit 150, so that raising or lowering the shaft 144 also respectively raises or lowers the drive unit 150. When the drive unit 150 is in its lowest position, the tapered engagement feature 154*a* is disengaged from the mating feature 149*a* on the housing 149, allowing the drive unit 150 and shaft 144 to rotate about the first axis 110. As the shaft 144 rotates about the first axis 110, the lever 141, the eccentric cam 142, and the two follower wheels 143 also rotate about the first axis 110. The follower wheels 143 are configured to roll on the bearing surface 145 such that the eccentric cam 142 and the shaft 144 are free to rotate about the first axis 110 with very little friction.

The shaft 144 has a stop feature 144*a* which interacts with the housing 149 to limit the range of rotated of the shaft 144 about the first axis 110. The stop feature 144*a* is configured so that at a first stop position, the drive unit 150 is in the first position, and the tapered engagement feature 154*a* on the drive unit 150 is aligned with the mating feature 149*a* on the housing 149. The stop feature 144*a* is configured so that at a second stop position, the drive unit 150 is in the second position, and the tapered engagement feature 154*a* on the drive unit 150 is again aligned with the mating feature 149*a* on the housing 149.

When the drive unit 150 is in either the first position or the second position and the tapered engagement feature 154*a* on the drive unit 150 is aligned with the mating feature 149*a* on the housing 149, the operator may rotate the lever 141 to rotate the eccentric cam 142 to raise the shaft 144 into its highest position. The shaft 144 is attached at its lower end to the drive unit 150, so that raising the shaft 144 into its highest position also raises the drive unit 150 into its highest position. The tapered engagement feature 154*a* on the drive unit 150 is raised until it is engaged with the mating feature 149*a*. When the tapered engagement feature 154*a* is engaged with the mating feature 149*a*, the shaft 144 and the drive unit 150 are locked in place, and the drive unit 150 is constrained from rotating about the first axis 110.

If the eccentric cam 142 merely raised the shaft 144 and drive unit 150 until the tapered engagement feature 154*a* was engaged with the mating feature 149*a*, the weight of the drive unit 150 pulling downward on the shaft 144 would have a tendency to rotate the eccentric cam 142 backward into the unlocked position, thus lowering the shaft 144 to its lowest position. The drive unit 150 stores potential energy as the weight of the drive unit 150 is raised, and loses potential energy as the weight of the drive unit 150 is lowered. If the locking mechanism 140 is designed so that no potential energy needs to be added to disengage the locking mechanism 140 from the fully locked position will tend to be unstable, allowing the locking mechanism 140 to drop from the locked position into the unlocked position. Conversely, any design that requires the addition of potential energy to disengage the locking mechanism 140 from the fully locked position will tend to stably retain the locking mechanism 140 in the locked position. The eccentric cam 142 needs to be configured to stably retain the shaft 144 in its highest position. One possible way to stably retain the shaft 144 in its highest position is to configure the eccentric cam 142 so that rotation of the eccentric cam 142 toward the locked position raises the shaft 144 to its highest point and then slightly lowers the shaft 144 as the eccentric cam 142 is rotated into the fully locked position. In other words, to disengage the eccentric cam 142 from the locked position, rotation of the eccentric cam 142 in a direction to unlock the locking mechanism 140 must first raise the shaft 144 before lowering the shaft 144 into its lowest position.

While an eccentric cam 142 configured to slightly drop the shaft 144 downward as the eccentric cam 142 is rotated into the fully engaged locked position creates a stable locked position, it causes one of two possible problems. A first possible problem is encountered if the eccentric cam 142 is configured to locate the shaft 144 in its highest position when the locking mechanism 140 is in its fully locked position. In this scenario, the eccentric cam 142 positions the shaft 144 and drive unit 150 at the proper height to firmly engage the tapered engagement feature 154*a* with the mating feature 149*a*, but the shaft 144 has nowhere to go to be raised from this fully locked position. The shaft 144 cannot be raised any higher once the tapered engagement feature 154*a* is fully engaged with the mating feature 149*a*, so the locking mechanism 140 is not truly in a stably locked position. A second possible problem is encountered if the eccentric cam 142 is configured to locate the shaft 144 in a location slightly below its highest position when the locking mechanism 140 is in its fully locked position, and the eccentric cam 142 is configured to locate the shaft 144 in its highest position as the locking mechanism 140 moves from its fully locked position toward its unlocked position. In this scenario, when the locking mechanism 140 is in the fully locked position, the eccentric cam 142 drops the shaft 144 downward slightly from its highest position, so that the tapered engagement feature 154*a* is not firmly engaged with the mating feature 149*a*, thereby allowing a little bit of play between the drive unit 150 and the frame 105. Play or rotation between the drive unit 150 and the frame 105 is undesirable when the locking mechanism 140 is in a fully locked configuration, so while this locking mechanism 140 would stably retain locking mechanism 140 in the fully locked position in this scenario, the tapered engagement feature 154*a* would not be fully engaged with the mating feature 149*a*, and the drive unit 150 would be able to move relative to the frame 105.

The addition of a spring washer 146 allows the locking mechanism 140 to fully engage the tapered engagement feature 154*a* with the mating feature 149*a* when the locking mechanism 140 is in the fully locked position, while still allowing the eccentric cam 142 to be configured to stably retain the locking mechanism 140 in the fully locked position. A spring washer 146 and threaded support surface 147 located beneath the bearing surface 145 allows the bearing surface 145 to move downward, instead of requiring an overconstrained shaft 144 to move upward after the tapered engagement feature 154*a* is fully engaged with the mating feature 149*a*.

The threaded support surface 147 is positioned within the housing 149 to provide support for the spring washer 146. The bearing surface 145 is placed in contact with the spring washer 146. The position of the threaded support surface 147 is adjustable, allowing fine control of the position of the spring washer 146 and the bearing surface 145 during the assembly process. The rest of the components of the locking mechanism 140 are assembled as described before.

The addition of the spring washer 146 does not change the operation of the locking mechanism 140 when the locking mechanism 140 is unlocked. In other words, the lever 141 is rotated to rotate the eccentric cam 142 into the unlocked position, lowering the shaft 144 to its lowest position, causing the tapered engagement feature 154*a* on the drive unit 150 to disengage from the mating feature 149*a*. In this unlocked state, the drive unit 150 and shaft 144 are free to rotate about the first axis 110.

During engagement of the locking mechanism 140, the lever 141 is rotated to rotate the eccentric cam 142 toward the locked position. As the eccentric cam 142 is rotated, the eccentric cam 142 raises the shaft 144 and drive unit 150 until the tapered engagement feature 154*a* becomes fully engaged with the mating feature 149*a*. Once the tapered engagement feature 154*a* becomes fully engaged with the mating feature 149*a*, the shaft 144 cannot move upward any more. As the eccentric cam 142 continues to be rotated toward the locked position, the eccentric cam 142 pushes the two follower wheels 143 downward on the bearing surface 145, which in turn compresses the spring washer 146.

The spring washer 146 stores energy as it is compressed, and releases energy as it is uncompressed. As the eccentric cam 142 continues to be rotated toward the locked position, the spring washer 146 continues to be compressed and continues to store energy until the eccentric cam 142 reaches a maximum offset position. As the eccentric cam 142 is rotated into its fully locked position, the eccentric cam 142 rotates away from the maximum offset position, and the spring washer 146 starts to expand, releasing some of the energy stored in the spring washer 146. When the locking mechanism 140 is in the fully locked position, the tapered engagement feature 154*a* is fully engaged with the mating feature 149*a* so that there is no play or rotation between the drive unit 150 and the frame 105, and the eccentric cam 142 is stably positioned in the fully locked position. The cam stop 142*a* prevents any further rotation of the eccentric cam 142 once the eccentric cam 142 has reached the fully locked position, and the eccentric cam 142 can only be rotated in the direction to disengage the locking mechanism 140.

With the addition of the spring washer 146, the locking mechanism 140 has three basic operating regimes. The first operating regime is when the locking mechanism 140 is in a disengaged state, where the spring washer 146 is in an uncompressed state, the shaft 144 and the drive unit 150 are lowered by the eccentric cam 142 so that the tapered engagement feature 154*a* is disengaged from the mating feature 149*a*, and the drive unit 150 is free to rotate about the first axis 110. The second operating regime is when the locking mechanism 140 is in a partially engaged state, where the shaft 144 and the drive unit 150 are raised by the eccentric cam 142 so that the tapered engagement feature 154*a* is engaged with the mating feature 149*a*, constraining the drive unit 150 so that the drive unit 150 is no longer able to rotate about the first axis 110, but the spring washer 146 is still in an uncompressed state so that the spring washer 146 is not applying a clamping force to maintain the engagement between the tapered engagement feature 154*a* and the mating feature 149*a*. The third operating regime is when the locking mechanism 140 is in a fully engaged state, where the shaft 144 and the drive unit 150 are raised by the eccentric cam 142 so that the tapered engagement feature 154*a* is engaged with the mating feature 149*a*, constraining the drive unit 150 so that the drive unit 150 is no longer able to rotate about the first axis 110, and the spring washer 146 is in an at least partially compressed state so that the spring washer 146 is applying a clamping force to maintain the engagement between the tapered engagement feature 154*a* and the mating feature 149*a*. In addition, the eccentric cam 142 is configured so that as the locking mechanism 140 moves from the partially engaged state to the fully engaged state, the eccentric cam 142 passes through a maximum offset position. The spring washer 146 goes from an uncompressed state to a maximum compressed state and back to partially compressed state as the locking mechanism 140 moves from the partially engaged state to the fully engaged state. The maximum compressed state of the spring washer 146 occurs as the eccentric cam 142 passes through the maximum offset position, and the partially compressed state of the spring washer 146 is less compressed than the maximum compressed state.

To disengage the locking mechanism 140 from the fully locked position requires that the eccentric cam 142 rotates back toward the maximum offset position, thus further compressing the spring washer 146, the spring washer 146 going from a partially compressed state to the maximum compressed state, and requiring an energy input to compress the spring washer 146. The requirement for energy to be input into the spring washer 146 to rotate the eccentric cam 142 from the fully locked position to the maximum offset position is what causes the locking mechanism 140 to be stably positioned in the fully locked position.

The threaded support surface 147 supplies an adjustment mechanism to fine tune the amount that the spring washer 146 is compressed when the eccentric cam 142 is in the fully locked position, as well as when the eccentric cam 142 is rotated into the maximum offset position. During assembly of the locking mechanism 140, rotating the threaded support surface 147 adjusts the position of the threaded support surface 147 up or down, setting the distance between the threaded support surface 147 and the mating feature 149*a*. The position of the threaded support surface 147 locates the spring washer 146 and the bearing surface 145 within the locking mechanism 140, and adjusts the amount of effort required by the operator of the exercise apparatus 100 to engage the eccentric cam 142 into the fully locked position, or disengage the eccentric cam 142 from the fully locked position. To limit the ability of the threaded support surface 147 to move after assembly, a locking ring 148 is added between the threaded support surface 147 and the housing 149. The locking ring 148 is attached to the threaded support surface 147 with a set screw (not shown) and the locking ring 148 is configured such that the locking ring 148 is prevented from rotating within the housing 149. The locking ring 148 prevents the threaded support surface 147 from rotating, thus preventing the threaded support surface 147 from changing its position within the housing 149 once the locking mechanism 140 is assembled.

It should be noted that a specific embodiment of a locking mechanism 140 has been described; however, different locking mechanisms could be used while remaining within the scope and spirit of the invention.

Figure 16:
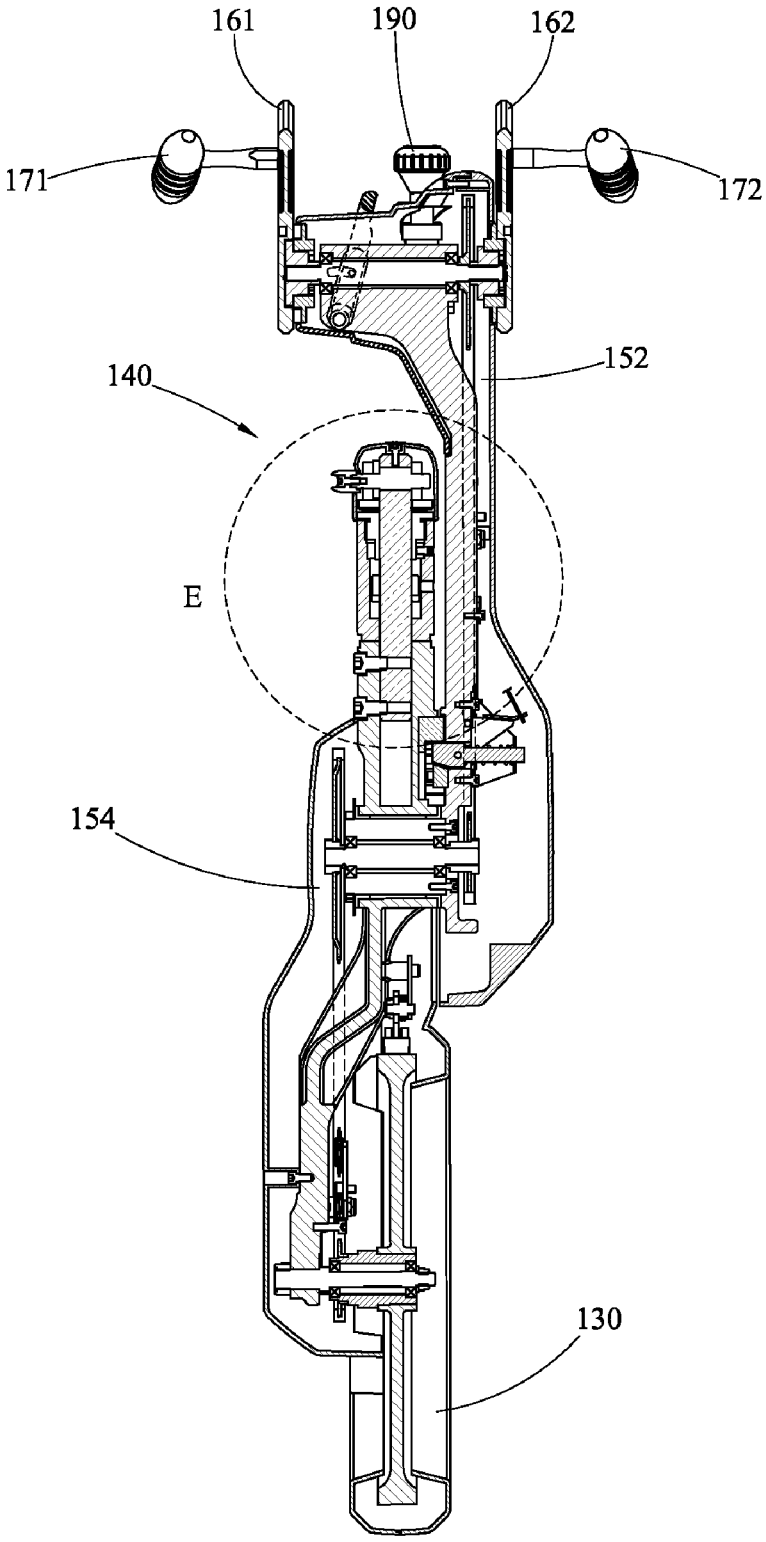
FIG. 16 is a cross-sectional view of the drive unit and locking mechanism of FIG. 1.

FIG. 16 shows a cross-sectional view of the drive unit 150, showing the crank arms 161, 162 connected to the respective hand pedals 171, 172 and the upper portion 152 of the drive unit 150, and the upper portion 152 of the drive unit 150 connected to the lower portion 154 of the drive unit 150.

Figure 17:
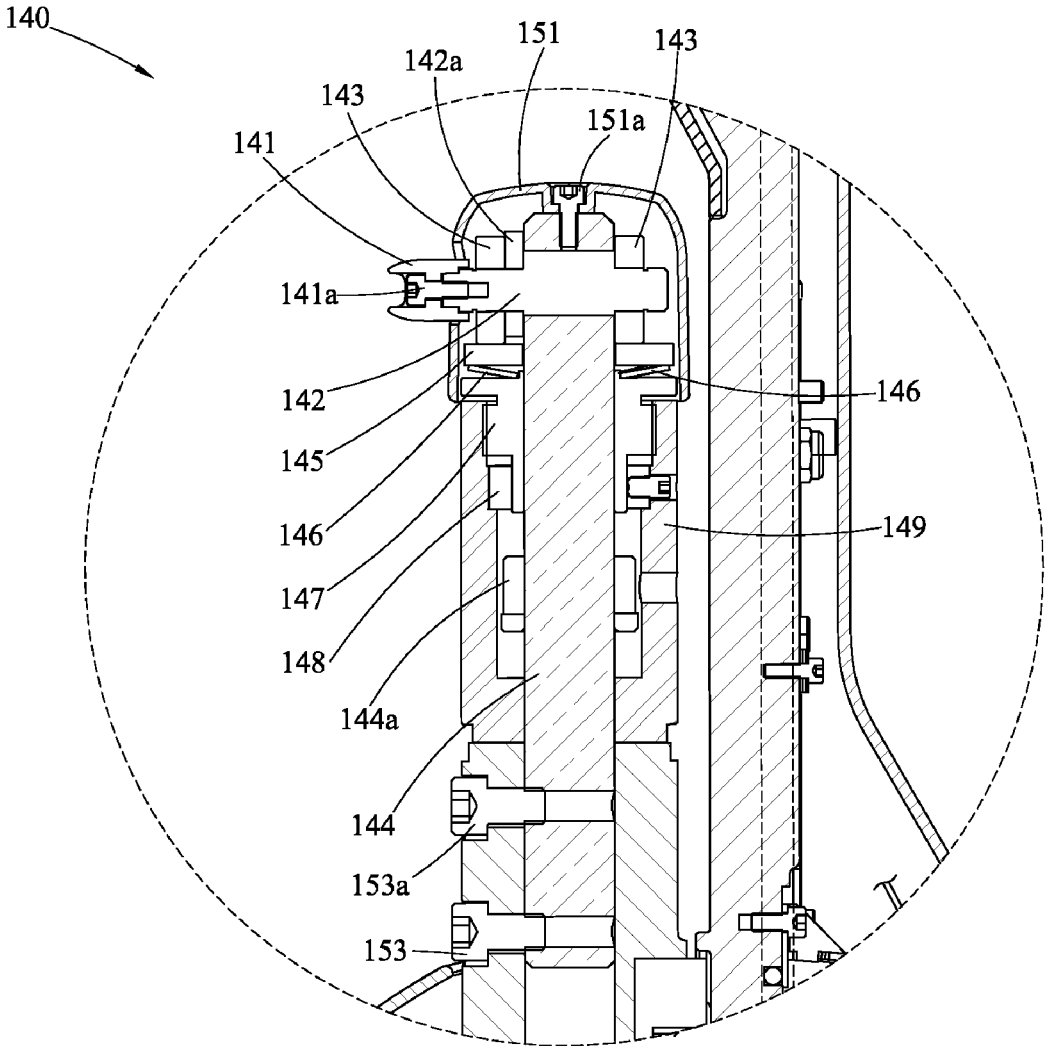
FIG. 17 is a detail view of the cross-sectional view of FIG. 16.

FIG. 17 shows a cross-sectional view of the locking mechanism 140 with the components of the locking mechanism 140 assembled in their assembled positions. The cap 151 is shown attached to the shaft 144 by a screw 151*a*. The lever 141 is shown attached to the eccentric cam 142 by a bolt 141*a* so that rotation of the lever 141 rotates the eccentric cam 142. The eccentric cam 142 is located within the bore hole through the shaft 144, and it is more easily seen in FIG. 17 how rotation of the eccentric cam 142 will cause the shaft 144 to be raised or lowered with respect to the bearing surface 145. In addition, the relative positions of the bearing surface 145, the spring washer 146 and the threaded support surface 147 is shown.

A method of performing an upper body spinning exercise having a frame 105, a first hand pedal 171 and a second hand pedal 172, a drive unit 150 pivotally mounted to the frame 105 for rotation about a first axis 110, a pair of crank arms 161, 162 pivotally mounted to the drive unit 150 about a second axis 120 and respectively connected to the hand pedals 171, 172, and having a flywheel 130, is to grasp at least one hand pedal 171, 172, then to rotate the hand pedal 171, 172 about a closed loop path about a second axis 120 in a first direction to impart rotation to the flywheel 130, and then to release the hand pedal 171, 172. Then, rotate the drive unit 150 about the first axis 110 from a first position to a second position to reverse the positions of the hand pedals 171, 172 and the crank arms 161, 162, then grasp at least one hand pedal 171, 172, and rotate the hand pedal 171, 172 around a closed loop path about the second axis 120 in a second direction opposite to the first direction to impart rotation to the flywheel 130.

The method of performing the upper body spinning exercise does not require that the same hand pedal 171, 172 be grasped both before and after the drive unit 150 has been rotated about the first axis 110. For instance, it is quite possible to grasp a first hand pedal 171 with the left hand, rotate the first hand pedal 171 about a closed loop path about a second axis 120 in a first direction to impart rotation to the flywheel 130, and then release the first hand pedal 171. Next, rotate the drive unit 150 about the first axis 110 from a first position to a second position to reverse the positions of the hand pedals 171, 172 and the crank arms 161, 162. Finally, grasp the second hand pedal 172 with the left hand, and rotate the second hand pedal 172 around a closed loop path about the second axis 120 in a second direction opposite to the first direction to impart rotation to the flywheel 130.

Similarly, the method of performing the upper body spinning exercise does not require that the same hand be used to grasp the same hand pedal 171, 172. For instance, it is possible to grasp a first hand pedal 171 with the left hand, rotate the first hand pedal 171 about a closed loop path about a second axis 120 in a first direction to impart rotation to the flywheel 130, and then release the first hand pedal 171. Next, rotate the drive unit 150 about the first axis 110 from a first position to a second position to reverse the positions of the hand pedals 171, 172 and the crank arms 161, 162. Finally, grasp the first hand pedal 171 with the right hand, and rotate the first hand pedal 171 around a closed loop path about the second axis 120 in a second direction opposite to the first direction to impart rotation to the flywheel 130.

The method also allows both hand pedals 171, 172 to be rotated simultaneously to impart rotation to the flywheel 130, or for both hand pedals 171, 172 to be grasped by an operator while only one hand pedal 171, 172 is rotated to impart rotation to the flywheel 130.

It is possible for the operator to rotate a first hand pedal 171 in a first direction about the second axis 120, while rotating a second hand pedal 172 in a second direction about the second axis 120. Or it is possible for the operator to rotate the first hand pedal 171 at a first rate in a first direction about the second axis 120, while rotating the second hand pedal 172 at a second rate in a first direction about the second axis 120.

Each hand pedal 171, 172 rotates its respective crank arm 161, 162 about the second axis 120, and each crank arm 161, 162 can rotate independently of the other crank arm 161, 162, therefore, the method allows either crank arm 161, 162 to be rotated about the second axis 120 in either a first or a second direction, so that the two crank arms 161, 162 may be aligned with one another, or oriented so that there is an angle between the first crank arm 161 and the second crank arm 162. Additionally, the method allows that the angle between the two crank arms 161, 162 may be changed at any time by the operator.

While the present invention has been described in terms of certain preferred embodiments, additions, deletions, substitutions, modifications and improvements can be made while remaining within the scope and spirit of the invention as defined by the following claims.

What is claimed is:

1. An exercise apparatus, comprising:

a frame designed to rest upon a floor surface and defining a vertical longitudinal midplane;

a drive unit pivotally connected to the frame and rotatable relative thereto about a first generally vertical axis between a first position and a second position;

a flywheel operatively connected to the drive unit;

a pair of hand pedals, each hand pedal configured to engage an operator's hand; and a pair of crank arms operatively connected to each respective hand pedal and rotatably mounted to the drive unit about a second axis which extends substantially perpendicular to the first axis, wherein the drive unit in the first position is configured to position the pair of crank arms on either side of the vertical midplane such that the second axis is extended substantially perpendicular to the vertical midplane, and wherein the drive unit in the second position is configured to reverse the position of the crank arms on either side of the vertical midplane such that the second axis is again extended substantially perpendicular to the vertical midplane, and wherein the drive unit is configured to impart rotation to the flywheel upon rotation of either crank arm in at least one direction about the second axis.

2. The exercise apparatus of claim 1, wherein rotation of drive unit about the first axis rotates the pair of hand pedals, the pair of crank arms and the second axis about the first axis.

3. The exercise apparatus of claim 1, further comprising a locking mechanism configured to constrain rotation of the drive unit about the first axis, wherein the drive unit is configured to be locked in at least the first position and the second position.

4. The locking mechanism of claim 3, comprising a tapered engagement feature associated with the drive unit and a mating feature associated with the frame, wherein the locking mechanism is configured to move the tapered engagement feature associated with the drive unit along the first axis and away from the mating feature associated with the frame when the locking mechanism is disengaged, such that the drive unit is rotatable in relation to the frame, and wherein the locking mechanism is configured to move the tapered engagement feature associated with the drive unit along the first axis toward and into engagement with the mating feature associated with the frame when the locking mechanism is engaged, such that the drive unit is fixed in relation to the frame.

5. The locking mechanism of claim 4, further comprising a clamping mechanism comprising a shaft, a bearing surface, and an eccentric cam pivotally connected to the shaft and in communication with the bearing surface, wherein the shaft is connected to the drive unit and configured to enable the drive unit to both rotate about the first axis and move axially along the first axis, and wherein the eccentric cam is configured to move the shaft in the axial direction with respect to the bearing surface, such that when the locking mechanism is disengaged, the eccentric cam is oriented to position the shaft at its lowest axial position with respect to the frame, and when the locking mechanism is fully engaged, the eccentric cam is oriented to position the shaft at its highest axial position with respect to the frame.

6. The clamping mechanism of claim 5, further comprising a spring in contact with the bearing surface and supported by the frame such that the bearing surface is configured to move with respect to the frame, wherein the locking mechanism is in a disengaged state when the spring is in a substantially uncompressed state and the eccentric cam is positioned to lower the drive unit downward in the axial direction such that the tapered engagement feature is disengaged from the mating feature and the drive unit is free to rotate about the first axis, and wherein the locking mechanism is in a partially engaged state when the spring is in a substantially uncompressed state and the eccentric cam is positioned to raise the drive unit upward in the axial direction to engage the tapered engagement feature with the mating feature such that the drive unit is prevented from rotating about the first axis, and wherein the locking mechanism is in a fully engaged state when the tapered engagement feature remains engaged with the mating feature and the eccentric cam presses upon the bearing surface such that the spring is at least partially compressed by the bearing surface and the compressed spring applies a clamping force to stably maintain the engagement between the tapered engagement feature and the mating feature, and wherein the fully engaged state is stably maintained by configuring the eccentric cam to increase the compression of the spring before relieving the compression of the spring as the locking mechanism is moved from the fully engaged state to the partially engaged state.

7. The exercise apparatus of claim 1, wherein rotation of either crank arm about the second axis moves the respective hand pedal around a closed loop path, and wherein the drive unit is configured to impart rotation to the flywheel when at least one of the hand pedals is rotated in a first direction about the closed loop path, and wherein the drive unit is configured to allow the respective crank arm to freewheel when at least one of the hand pedals is rotated in a second direction about the closed loop path opposite to the first direction.

8. The exercise apparatus of claim 1, wherein the pair of crank arms is comprised of a first crank arm and a second crank arm, and wherein the drive unit is configured to enable the first crank arm to stop rotating while the drive unit continues to impart rotation to the flywheel due to the rotation of the second crank arm in a first direction, and wherein the drive unit is configured to enable the second crank arm to stop rotating while the drive unit continues to impart rotation to the flywheel due to the rotation of the first crank arm in the first direction.

9. The exercise apparatus of claim 1, wherein the pair of crank arms is comprised of a first crank arm and a second crank arm, and wherein the first crank arm rotates at a faster rate of rotation in a first direction about the second axis and the second crank arm rotates at a slower rate of rotation in a first direction about the second axis, and wherein the drive unit is configured to enable the faster rotating first crank arm to impart rotation to the flywheel.

10. The exercise apparatus of claim 1, wherein the crank arms are configured to be infinitely adjustable in their orientation relative to each other and wherein the crank arms are operatively engaged with the drive unit in a non-fixed orientation relative to each other to enable the crank arms to be positioned in an opposed orientation with the crank arms 180 degrees apart, or repositioned in a tandem orientation with the crank arms side by side, or repositioned to any orientation of the crank arms relative to each other.

11. The exercise apparatus of claim 1, further comprising a resistance device operatively associated with the flywheel and configured to impede the rotation of the flywheel, and a control device cooperatively associated with the resistance device and configured to adjust the magnitude of the impedance to rotation exerted by the resistance device on the flywheel.

12. The exercise apparatus of claim 1, further comprising a seat removably connected to the frame.

13. An exercise apparatus, comprising:

a frame designed to rest upon a floor surface, the frame having a front end, a right side and a left side;

a drive unit pivotally connected to the frame and rotatable relative thereto about a first generally vertical axis between a first position and a second position rotated 180 degrees relative to the first position;

a flywheel operatively connected to the drive unit;

a first and second crank arm rotatably mounted to the drive unit about a second axis which extends substantially perpendicular to the first axis;

a pair of hand pedals, each hand pedal operatively connected to each respective crank arm and each hand pedal configured to engage an operator's hand, permitting an operator to rotate at least one hand pedal about a closed loop path; and the drive unit configured such that when the drive unit is in the first position, the first crank arm is on the right side and the second crank arm is on the left side with respect to the frame and rotation of either crank arm in a first direction about the second axis imparts rotation to the flywheel and rotation of either crank arm in a second direction opposite to the first direction allows the crank arm to freewheel about the second axis, and when the drive unit is in the second position, the crank arms are reversed, such that the first crank arm is on the left side and the second crank arm is on the right side with respect to the frame and rotation of either crank arm in the first direction allows the crank arm to freewheel about the second axis and rotation of either crank arm in the second direction about the second axis imparts rotation to the flywheel.

14. The exercise apparatus of claim 13, further comprising a locking mechanism configured to constrain rotation of the drive unit about the first axis, wherein the drive unit is configured to be locked in at least the first position and the second position.

15. The exercise apparatus of claim 13, wherein rotation of either crank arm about the second axis in the first direction moves the respective hand pedal around a closed loop path that is moving toward the front end of the frame when the hand pedal is at its highest point of travel, and wherein rotation of either crank arm about the second axis in the second direction moves the respective hand pedal around a closed loop path that is moving toward the front end of the frame when the hand pedal is at its lowest point of travel.

16. The exercise apparatus of claim 13, wherein rotation of either crank arm about the second axis moves the respective hand pedal around a closed loop path, and wherein the drive unit is configured to impart rotation to the flywheel when at least one of the hand pedals is rotated in a first direction about the closed loop path, and wherein the drive unit is configured to allow the respective crank arm to freewheel when at least one of the hand pedals is rotated in a second direction about the closed loop path opposite to the first direction.

17. The exercise apparatus of claim 13, wherein the first crank arm and the second crank arm are configured to be infinitely adjustable in their orientation relative to each other and wherein the first crank arm and the second crank arm are operatively engaged with the drive unit in a non-fixed orientation relative to each other to enable the first crank arm and the second crank arm to be positioned in an opposed orientation with the first crank arm rotated 180 degrees apart from the second crank arm, or repositioned in a tandem orientation with the first crank arm and the second crank arm side by side, or repositioned to any orientation of the first crank arm and the second crank arm relative to each other.

18. A method of performing an upper body spinning exercise having a frame, a first hand pedal and a second hand pedal, a drive unit rotatably mounted to the frame for rotation about a first generally vertical axis, a pair of crank arms rotatably mounted to the drive unit about a second axis and respectively connected to the hand pedals, and a flywheel, the method comprising the steps of:

Grasping at least the first hand pedal;

Rotating at least the first hand pedal around a closed loop path about a second axis in a first direction to impart rotation to the flywheel;

Releasing at least the first hand pedal;

Rotating the drive unit about the first axis from a first position to a second position to reverse the positions of the hand pedals and crank arms;

Grasping at least the second hand pedal; and

Rotating at least the second hand pedal around the closed loop path about the second axis in a second direction opposite to the first direction to impart rotation to the flywheel.

19. The method of claim 18, the method further comprising the steps of:

Grasping the first and second hand pedals;

Rotating the first hand pedal about the second axis in the first direction to impart rotation to the flywheel while holding the second hand pedal stationary; and Rotating the second hand pedal about the second axis in the first direction to impart rotation to the flywheel while holding the first hand pedal stationary.

20. The method of claim 18, the method further comprising the steps of:

Grasping the first and second hand pedals;

Rotating both the first and second hand pedals about the second axis in the first direction so that there is a constant angle between the crank arms as the crank arms impart rotation to the flywheel;

Rotating the first hand pedal around the closed loop path about the second axis in a second direction to change the angle between the crank arms to a new angle;

Rotating both the first and second hand pedals about the second axis in the first direction with the new angle between the crank arms as the crank arms impart rotation to the flywheel.

* * * * *